United States Patent [19]

Plaut

[11] 4,114,531

[45] Sep. 19, 1978

[54] COMPACTING APPARATUS

[75] Inventor: Werner P. B. Plaut, Forest Hills, N.Y.

[73] Assignee: Flexowall Corporation, Clinton, Conn.

[21] Appl. No.: 692,098

[22] Filed: Jun. 2, 1976

[51] Int. Cl.[2] ..... B30B 9/00; B30B 9/24

[52] U.S. Cl. ..... 100/90; 100/118; 100/152; 53/526

[58] Field of Search ..... 100/90, 91, 118–120, 100/151–154; 53/124 CC, 124 D, 24

[56] References Cited

U.S. PATENT DOCUMENTS

| | | | |
|---|---|---|---|
| 2,415,355 | 2/1947 | Kaufmann et al. | 100/152 |
| 2,618,816 | 11/1952 | Joa | 100/152 |
| 3,063,362 | 11/1962 | Guettler | 100/118 X |
| 3,546,846 | 12/1970 | Sens | 53/24 |
| 3,886,713 | 6/1975 | Mitchell et al. | 53/24 |
| 3,929,065 | 12/1975 | Csordas et al. | 100/90 |

*Primary Examiner*—Peter Feldman

*Attorney, Agent, or Firm*—Shenier & O'Connor

[57] ABSTRACT

Apparatus for compacting loose, spongy or disintegrated solid material in which a pair of conveyor surfaces, one of which is fluid-pervious but solid-impervious, are disposed in convergent spaced relation with one another to form a compacting zone. Fluid is removed from the compacting zone through the fluid-pervious conveyor surface. Material to be compacted is supplied to the divergent end of the compacting zone while the surfaces are moved towards the convergent end of the compacting zone to cause the material to be compacted.

3 Claims, 4 Drawing Figures

Fig 1
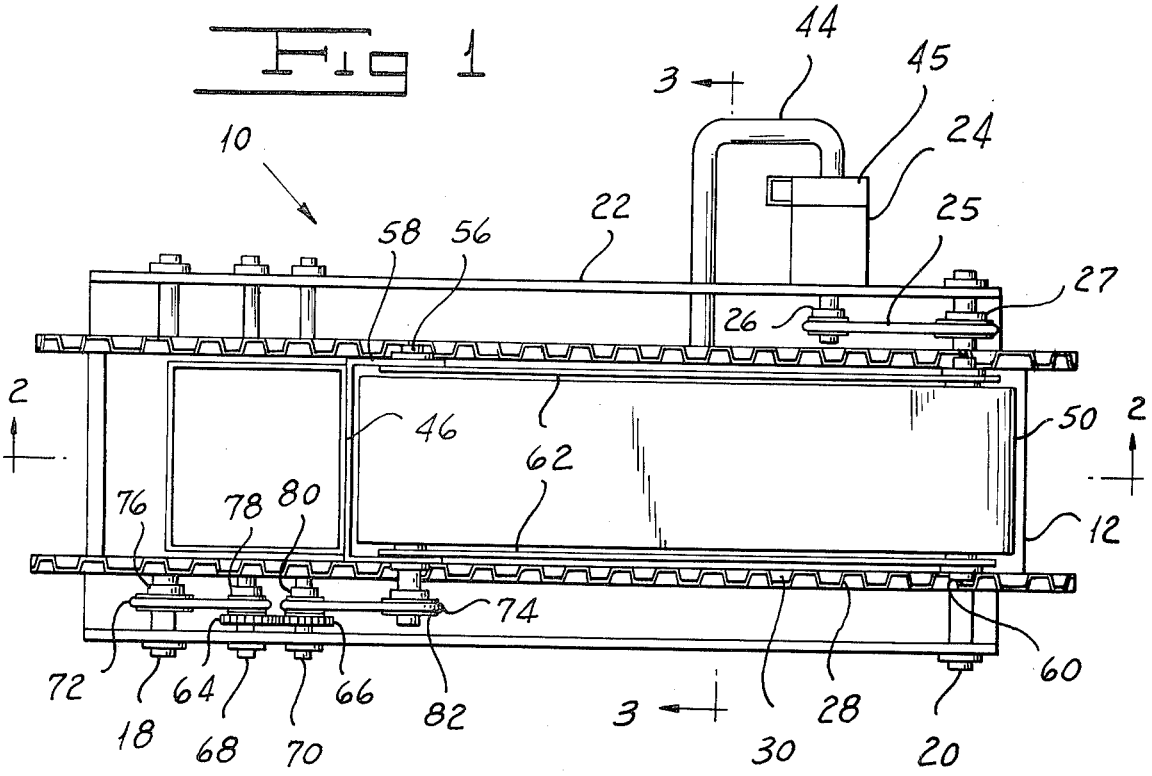
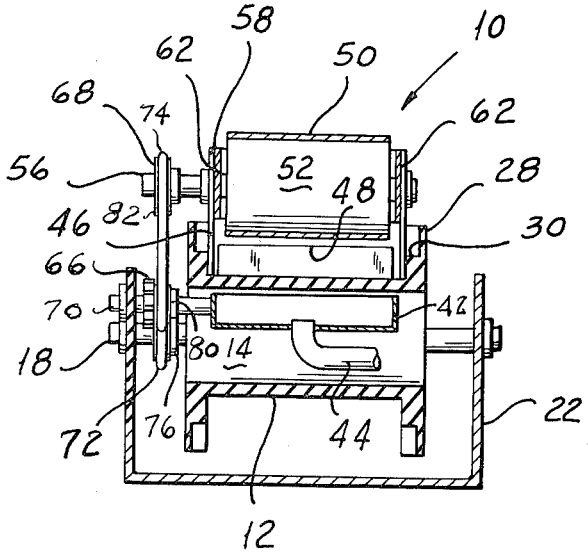
Fig 3

Fig 2
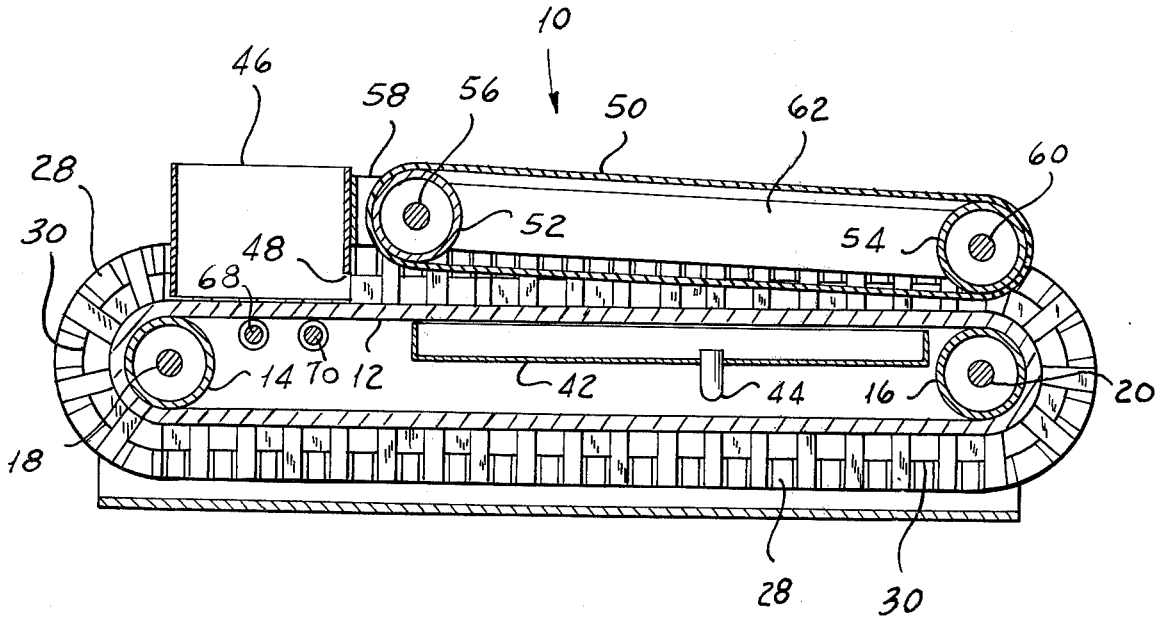
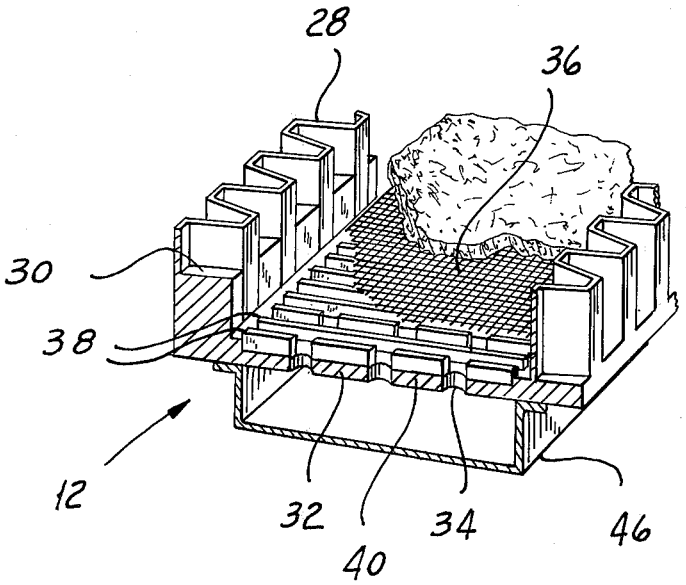
Fig 4

COMPACTING APPARATUS

BACKGROUND OF THE INVENTION

This invention relates to apparatus for compacting materials such as cotton or tissue paper or the like.

It is often necessary to compact or compress materials, such as cotton or tissue paper, either to conserve storage space or preliminary to disposing of such materials. If such materials are simply compacted by being compressed mechanically, means must be provided for permitting escape of the air trapped in the compression process. It is difficult to accomplish this, however, without also causing some of the material itself to be expelled into the environment. While there exist vacuum systems for removing air from material such systems have drawbacks. In particular, the shear exerted on the material by the stationary vacuum devices tends to impede the movement of the material along the line and thus adversely affects the operation of the system.

SUMMARY OF THE INVENTION

One of the objects of my invention is to provide a compacting apparatus which minimizes the escape into the environment of stray particles of the material being compacted.

Another object of my invention is to provide a compacting apparatus which does not exert a shear force on the material being compacted.

Other and further objects will be apparent from the following disclosure.

In general, my invention contemplates the provision of a compacting apparatus comprising a pair of conveyor surfaces arranged in spaced convergent relationship with one another to define a compacting zone, one of the conveyor surfaces being fluid-pervious but solid-impervious, means for removing fluid from the compacting zone through means for removing fluid the compacting zone through the fluid-pervious conveyor surface, means for supplying the material to be compacted to the divergent end of the compacting zone, and means for moving the surfaces towards the convergent end of the compacting zone to cause the material to be compacted.

BRIEF DESCRIPTION OF THE DRAWINGS

FIG. 1 is a top plan of my compacting apparatus.

FIG. 2 is a section of the apparatus shown in FIG. 1, taken along line 2—2 thereof.

FIG. 3 is a section of the apparatus shown in FIG. 1, taken along line 3—3 thereof.

FIG. 4 is a perspective of the lower belt and vacuum chamber of the apparatus shown in FIG. 1, drawn on an enlarged scale and in greater detail.

DETAILED DESCRIPTION OF THE PREFERRED EMBODIMENT

Referring now to the drawings, my apparatus, indicated generally by the reference numeral 10, comprises a fluid-pervious, solid-impervious lower conveyor belt 12 which is trained between respective rollers 14 and 16. Rollers 14 and 16 are mounted on respective shafts 18 and 20 which are rotatably received by upstanding portions of a suitable frame member 22. Shaft 20 is rotated in a clockwise direction, as seen in FIG. 2, by a motor 24 coupled to the shaft 20 by a belt 25 supported on pulleys 26 and 27.

The conveyor belt 12 includes a pair of upstanding side walls 28 which are corrugated to permit movement around the pulleys 14 and 16. To prevent air from reaching the belt 12 through the corrugated walls 28, the inner faces of the walls 28 are formed with shoulder portions 30 which are flush with the inner folds of the inner faces of the side walls 28.

Referring to FIG. 4, the transverse portion of the conveyor belt 12 is formed from a resilient base layer 32 having a plurality of relatively large perforations 34. I cover the base layer 32 with a relatively thin fluid-pervious, but solid-impervious layer 36 such as a suitable filter cloth. Preferably, to permit better distribution of air between the perforations 34, the base layer 32 is formed with a plurality of transverse ribs 38, the spacing of which is small compared to the size of the perforations 34. If desired, the transverse ribs may be formed on a resilient intermediate layer 40 which is later adhered to the base layer 32.

I mount a vacuum chamber 42 beneath the upper run of the lower conveyor belt 12. A vacuum pump 45 exhausts the vacuum chamber 42 through a conduit 44. Conveniently, the pump 45 may be a centrifugal pump which is directly coupled to the motor 24. The chamber 42 extends laterally across the width of the belt 12 and lengthwise from the roller 16 rearward. A bottomless hopper 46 disposed above the belt 12 supplies the belt with material to be compacted at a location adjacent to roller 14. Hopper 46, which extends nearly across the width of belt 12, is provided with an opening 48 along the bottom of its front wall, through which the material is drawn by the forward motion of the belt 12.

An upper conveyor belt 50 trained between a roller 52 and a roller 54 is provided to form a compacting zone in which the material is compacted as it is carried through the zone by the lower belt 12. The roller 52 is supported by a shaft 56 which in turn is rotatably received by a bracket 58 fixedly mounted to the hopper 46. A shaft 60, rotably received in a pair of pivot arms 62, supports the roller 54. Preferably, I so arrange the roller 52 that the belts 12 and 50 converge at an angle of between 2° and 10°. Upper belt 50, which is made of a fluid-impervious material, extends laterally nearly to the corrugated side walls 28. A small clearance gap is left to permit relative movement of the members. Belt 50 is driven counterclockwise, preferably at the same speed as the belt 12 by any suitable drive means. In the embodiment shown, a pair of reversing gears 64 and 66 supported on respective shafts 68 and 70 are coupled to shafts 18 and 56 by respective drive belts 72 and 74. Drive belt 72 is supported by pulleys 76 and 78 mounted respectively on shafts 18 and 68, while belt 74 is supported by pulleys 80 and 82 mounted on respective shafts 70 and 56.

In operation of my apparatus, the material to be compacted is supplied to the hopper 46 through its open top and is then drawn through the opening 48 by the forward movement of the belts 12 and 50 and by the partial vacuum provided in the compacting zone. When the material passes between the belts 12 and 50, the vacuum from the vacuum chamber 42 tends to remove the air trapped between said belts and pulls the upper belt 50 downwardly to compress the material and urge the pulley 54 against the opposing pulley 16. Because of the shoulders 30 on the corrugated side walls 28, the intake of air through the sides of the belts is minimized. The material is ultimately discharged in the form of a compressed mat from the nip formed by opposing pulleys 54 and 56.

It will be seen that I have accomplished the objects of my invention. Because compaction is accomplished by deaeration, the expulsion of the compacted material into the environment which usually accompanies compaction using mechanical or pneumatic compression is reduced or eliminated. Further, because all of the surfaces in contact with the material are moving at the same speed, the material is drawn forward in a smooth and continuous manner, owing to the absence of any spurious shear forces introduced by stationary portions of the apparatus.

It will be understood that certain features and subcombinations are of utility and may be employed without reference to other features and subcombinations. This is contemplated by and is within the scope of my claims. It is further obvious that various changes may be made in details within the scope of my claims without departing from the spirit of my invention. It is, therefore, to be understood that my invention is not to be limited to the specific details shown and described.

Having thus described my invention, what I claim is:

1. Apparatus for compacting a flocculent solid material comprising:

an air-pervious lower conveyor belt;

a relatively air-impervious upper belt;

means for supporting said upper belt above said lower conveyor belt to form a convergent compacting zone having a convergent end and a divergent end, said supporting means including a first roller supporting said upper belt at the convergent end of said zone, a second roller supporting said upper belt at the divergent end of said zone, means mounting said first roller for vertical movement in the direction of said lower belt, and means mounting said second roller at a substantially fixed vertical position above said lower belt;

means for supplying said material to said lower belt at the divergent end of said compacting zone;

means for moving the opposing portions of said belts toward the convergent end of said compacting zone; and means including a suction device for withdrawing air from the compacting zone solely through the air-pervious lower belt.

2. Apparatus for compacting a flocculent solid material comprising:

an air-pervious lower conveyor belt;

a relatively air-impervious upper belt;

means for supporting said upper belt above said lower conveyor belt to form a convergent compacting zone having a convergent end and a divergent end, said lower belt including upstanding and relatively air-impervious sidewalls defining the lateral boundaries of said compacting zone, said supporting means including a first roller supporting said upper belt at the convergent end of said zone, a second roller supporting said upper belt at the divergent end of said zone, means mounting said first roller for vertical movement in the direction of said lower belt, and means mounting said second roller at a substantially fixed vertical position above said lower belt;

means for supplying said flocculent solid material to said lower belt at the divergent end of said compacting zone;

means for moving the opposing portions of said belts toward the convergent end of said compacting zone; and means including a suction device for withdrawing air from the compacting zone through the air-pervious lower belt.

3. Apparatus for compacting a flocculent solid material comprising:

an air-pervious lower conveyor belt;

a relatively air-impervious upper belt;

means for supporting said upper belt above said lower conveyor belt to form a convergent compacting zone having a convergent end and divergent end, said supporting means including a first roller supporting said upper belt at the convergent end of said zone, a second roller supporting said upper belt at the divergent end of said zone, means mounting said first roller for vertical movement in the direction of said lower belt, and means mounting said second roller at a substantially fixed vertical position above said lower belt;

means including a hopper disposed over said lower belt for supplying said material to the divergent end of said compacting zone;

means for moving the opposing portions of said belt toward the convergent end of said compacting zone; and means including a suction device for withdrawing air from the compacting zone through the air-pervious lower belt.

* * * * *